US008540049B2

(12) United States Patent
Silver

(10) Patent No.: US 8,540,049 B2
(45) Date of Patent: Sep. 24, 2013

(54) ACOUSTIC DIAPHRAGM SUSPENDING

(75) Inventor: Jason D. Silver, Framingham, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 12/977,484

(22) Filed: Dec. 23, 2010

(65) Prior Publication Data

US 2012/0160598 A1 Jun. 28, 2012

(51) Int. Cl.

| | |
|---|---|
| ***G10K 13/00*** | (2006.01) |
| ***H04R 1/00*** | (2006.01) |
| ***H04R 7/00*** | (2006.01) |
| ***H04R 9/06*** | (2006.01) |

(52) U.S. Cl.
USPC ..... 181/172; 181/171; 381/398

(58) Field of Classification Search
USPC ..... 181/172, 171, 167; 381/398
See application file for complete search history.

(56) References Cited

U.S. PATENT DOCUMENTS

| | | | | |
|---|---|---|---|---|
| 2,646,853 | A | 7/1953 | Pocock | |
| 2,840,177 | A | 6/1958 | Schoengold | |
| 3,424,873 | A * | 1/1969 | Walsh | 381/346 |
| 3,684,052 | A * | 8/1972 | Sotome | 381/398 |
| 4,122,314 | A | 10/1978 | Matsuda et al. | |
| 4,861,161 | A * | 8/1989 | Ljung | 356/469 |
| 5,361,669 | A * | 11/1994 | Genna | 84/414 |
| 5,386,894 | A * | 2/1995 | Barca | 188/379 |
| 5,739,481 | A * | 4/1998 | Baumhauer et al. | 181/148 |
| 5,909,078 | A * | 6/1999 | Wood et al. | 310/307 |
| 6,044,925 | A | 4/2000 | Sahyoun | |
| 6,160,898 | A | 12/2000 | Bachmann et al. | |
| 6,219,432 | B1 * | 4/2001 | Fryer et al. | 381/398 |
| 7,236,601 | B1 | 6/2007 | Bachmann et al. | |
| 7,699,139 | B2 * | 4/2010 | Subramaniam et al. | 181/171 |
| 2003/0084726 | A1 * | 5/2003 | Yamazaki et al. | 73/587 |
| 2004/0096247 | A1 * | 5/2004 | Ki et al. | 399/286 |
| 2005/0147272 | A1 * | 7/2005 | Hyre et al. | 381/398 |
| 2008/0296086 | A1 * | 12/2008 | Subramaniam et al. | 181/142 |
| 2009/0139794 | A1 * | 6/2009 | Silver | 181/171 |
| 2009/0161906 | A1 * | 6/2009 | Adelman | 381/418 |
| 2010/0014702 | A1 * | 1/2010 | Silver | 381/398 |
| 2012/0114136 | A1 * | 5/2012 | Horigome et al. | 381/86 |

FOREIGN PATENT DOCUMENTS

| | | | |
|---|---|---|---|
| EP | 466540 | A * | 1/1992 |
| GB | 308776 | A | 4/1930 |
| GB | 2315185 | A * | 1/1998 |

OTHER PUBLICATIONS

Notification of Transmittal of the International Search Report and the Written Opinion of the International Searching Authority, dated Mar. 13, 2012 for PCT/US2011/066318.

* cited by examiner

*Primary Examiner* — David Warren
*Assistant Examiner* — Christina Russell
(74) *Attorney, Agent, or Firm* — Bose Corporation

(57) ABSTRACT

A suspension element for mechanically coupling an acoustic diaphragm to a stationary element. The suspension element is characterized by a total compliance. The total compliance includes a shear compliance and a beam compliance. The beam compliance is not significantly larger than the shear compliance.

8 Claims, 5 Drawing Sheets

ACOUSTIC DIAPHRAGM SUSPENDING

BACKGROUND

This specification describes a suspension element (or "surround") for an acoustic diaphragm for use in an acoustic driver or an acoustic passive radiator.

SUMMARY

In one aspect of the specification, a suspension element for mechanically coupling an acoustic diaphragm to a stationary element is characterized by a total compliance, and the total compliance comprises a shear compliance and a beam compliance and the beam compliance is not significantly larger than the shear compliance. The shear compliance may be greater than the beam compliance. The material of the suspension element may have a Young's modulus of about 0.031 MPa. The material of the suspension element may be silicone rubber. The silicone rubber may be treated with a softening agent. The material of the suspension element may be a polyurethane. The suspension element and the diaphragm may be components of a passive radiator. The suspension may include flanges for capturing the acoustic diaphragm.

In another aspect of the specification, a suspension element for mechanically coupling an acoustic diaphragm to a stationary element is characterized by a width and a thickness. The ratio of the width to the thickness is less than 2:1. ratio of the width to the thickness may be 1:1 or less The suspension element may include a material with a Young's modulus of about 0.031 MPa. The silicone rubber may be treated with a softening agent. The material of the suspension element may be a polyurethane. The suspension element and the acoustic diaphragm may be components of an acoustic passive radiator. The suspension element may include flanges to capture the acoustic diaphragm.

In another aspect of the specification, a suspension element for mechanically coupling an acoustic diaphragm to a stationary element includes a ring shaped structure characterized by a radial axis. In operation, the suspension element deforms in a direction perpendicular to the radial axis and in operation the radial axis remains substantially straight. The ring shaped structure may be characterized by a width measured along the radial axis and a thickness measured perpendicular to the radial axis. The width may be less than twice the thickness. The width may be less than the thickness. The suspension may be formed of silicone rubber. The suspension may be formed of a polyurethane.

Other features, objects, and advantages will become apparent from the following detailed description, when read in connection with the following drawing, in which:

DETAILED DESCRIPTION

Some of the processes may be described in block diagrams. The activities that are performed in each block may be performed by one element or by a plurality of elements, and may be separated in time. The elements that perform the activities of a block may be physically separated. One element may perform the activities of more than one block.

Figure 1A:
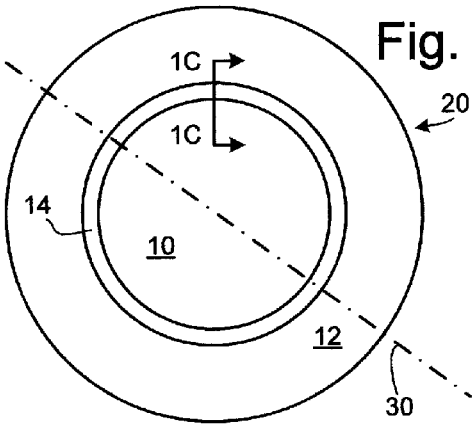
FIGS. 1A, 1B, and 1C are views of an acoustic assembly including a suspension element.
Figure 1C:
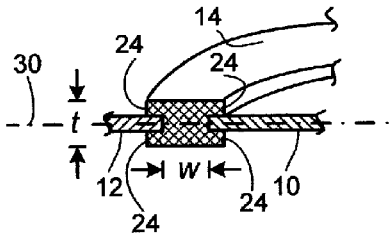
Figure 1B:
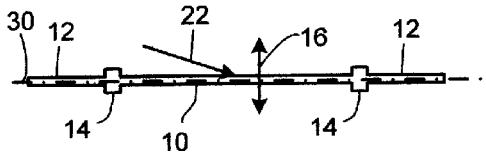

FIGS. 1A and 1B show, respectively, a top plan view and a side plan view of an acoustic assembly 20 including an acoustic diaphragm 10 mechanically coupled along its circumference to a support structure 12 by a suspension element 14. The suspension element permits vibration of the acoustic diaphragm 10 in the direction indicated by arrow 16.

The acoustic diaphragm 10 can be planar, as shown, or may be cone shaped or some other shape. The acoustic diaphragm 10 may be circular as shown, or non-circular, for example an oval shape or a "racetrack" shape, or a shape not bounded by continuously curved line, such as a square. The suspension element 14 is characterized by radial axes such as radial axis 30 that lie in a plan perpendicular to the intended direction of motion indicated by arrow 16. "Radial" does not limit the suspension to circular diaphragms. If the diaphragm is non-circular, "radial" is taken relative to the geometric center of the diaphragm, and extending through the diaphragm and the suspension element. The support structure can be the wall of an acoustic enclosure or may be the frame or "basket" of an acoustic driver. For purposes of this specification, the support structure is fixed and is therefore represented in FIGS. 2A, 2B, 2D, and 3 as a mechanical ground. The acoustic assembly 20 may be a passive radiator as shown, or may be an acoustic driver, in which case the acoustic assembly could include a linear motor, which could include a magnet structure and voice coil. The suspension element 14, in this example a surround for a passive radiator, could instead be a surround for an acoustic driver, or could be a spider, depending on the requirements of the spider.

FIG. 1C shows a partial cross-sectional view taken along line 1C-1C of FIG. 1A, from an elevated position in an oblique direction, as indicated by arrow 22 of FIG. 1B. The ratio of the width w of the body (that is, excluding the width of the flanges 24) of the suspension element 14 to the thickness t (hereinafter the width to thickness ratio) of the suspension element is less than 2:1, in this example approximately 1:1.

The suspension element has at least three functions: (1) to permit pistonic motion in the directions indicated by arrow 16 while inhibiting non-pistonic motion; (2) to exert a restorative force to urge the diaphragm to a neutral position; and (3) to provide a pneumatic seal between the two sides of the acoustic diaphragm. "Pistonic" motion, as used herein, refers to rigid body motion in which all points of the diaphragm move in the same direction (typically axially) at the same rate. Non-pistonic rigid body motion in which some points of the diaphragm move in different directions or move in the same direction at different rates is referred to as "rocking" and adversely affects the efficiency of the acoustic assembly or results in less acoustic energy being radiated than when the diaphragm is operating pistonically, or both. Non-pistonic motion in a radial motion adversely affects the operation of the acoustic assembly, and in the case of an acoustic driver, can cause damage to elements of the acoustic driver.

Figure 2A:
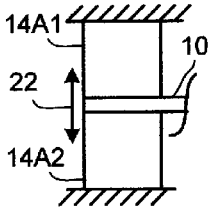
FIGS. 2A, 2B, and 2D are diagrammatic illustrations of acoustic suspension elements.
Figure 2A:
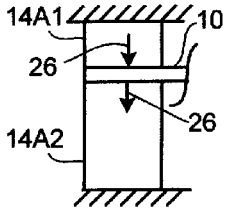
Figure 2B:
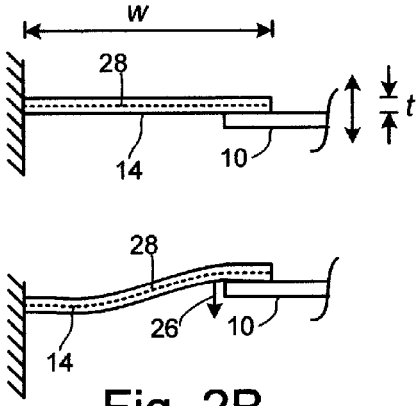

FIGS. 2A and 2B illustrate different configurations of suspension elements. In FIG. 2A, the suspension element includes two compressible, stretchable sections, 14A1 and 14A2. Motion indicated by arrow 22 compresses one section, in this example 14A1 and extends the other section, in this example, 14A2 as shown in FIG. 2B, resulting in a restorative force in this example in the direction indicated by arrows 26.

In a suspension element such as shown in FIG. 2B, in which the width to thickness ratio is large, for example greater than 5:1, in this example, about 16:1 the suspension element exhibits predominantly beam-like deformation. In beam-like deformation, motion in the intended direction causes the suspension element to deform so that an axis 28 of the cross section of the suspension element 14 becomes curved. The deformation of the beam causes strain, which places the beam partially in compression and partially in tension, which results in a restoring force which has an axial component, as indicated by arrow 26.

Figure 2C:
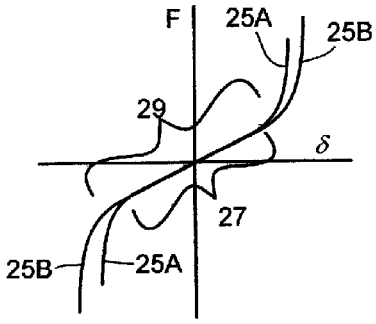
FIG. 2C is a force v. deflection curve for two acoustic suspension elements.

A curve 25A of Force (F) vs. deflection (δ) of FIG. 2C varies linearly over a range 27 of forces and deflections. To increase the range of linearity of force and deflection in the configuration of FIG. 2B, the geometry of the suspension element 14 can be modified. For example, the width w can be increased. However, this is disadvantageous because it increases the overall diameter of the acoustic assembly. One method of providing a larger range of linearity without increasing the overall diameter as much as simply increasing the width of the suspension element is to modify the geometry of the suspension element, for example using a half roll surround 14D shown in FIG. 2D. Motion of the diaphragm causes the half roll to "unroll", resulting in a curve 25B with a larger range of linearity of force and deflection, for example range 29 of FIG. 2C.

One problem of changing the geometry of suspension elements is that changing the geometry of the surround can in itself cause non-linearities. For example the slope of the Force vs. Deflection curve may be asymmetric so that the curve has a different slope or has a different range of deflection in which the suspension element behaves linearly depending in which direction the diaphragm is moving.

Other types of suspension elements that improve the symmetry of the Force vs. Deflection curve or increase the range of linearity include more complex geometries such as multiple rolls, and radial or circumferential ribs, for example, as described in U.S. Pat. No. 7,699,139 issued Apr. 20, 2010 to Subramaniam et al.

One drawback of the suspension elements described above is that, even with complex geometries and structure such as ribs, the suspension elements may be wider than desired. For example, if high excursion is required from a transducer with a relatively small diaphragm, the area of the suspension element may approach or even exceed the area of the radiating surface. Wide surrounds are also especially disadvantageous if it is desired to place an acoustic driver or passive radiator in a physically small device, particularly if a large displacement in required. Stated differently, the maximum excursion over which suspension has a linear force deflection curve depends on the width of the suspension element and the geometry of the suspension element. Additionally, the suspension material may have a non-linear stress-strain curve (non-constant Young's modulus of elasticity), which also can define the range of excursion over which the suspension behaves linearly. Typically, the maximum excursion of diaphragm mechanically coupled by a suspension element as described above is no more than about 0.6 times (measured from neutral position) the width of the suspension element for a half roll surround operating in the linear region of a force/deflection curve.

Another drawback of relatively wide suspension is that they may be prone to deformation from internal enclosure pressures. For example, if a diaphragm mounted in a closed enclosure, particularly a small enclosure, moves inward, the pressure inside the enclosure increases, causing an outward force to be exerted on the suspension over its area. If the width is relatively large, for example, five times or more the thickness, the stiffness of the suspension may not be adequate to resist deforming outwardly, for example by bowing outwardly, which reduces acoustic output. Similarly, outward movement of the diaphragm results in a reduction of pressure inside the enclosure, resulting in an inward force on the suspension, resulting in inward deformation of the suspension. Since the direction of the deformation is opposite to the direction of movement of the diaphragm, the deformation can result in a reduction of the acoustic output of the device.

Figure 2D:
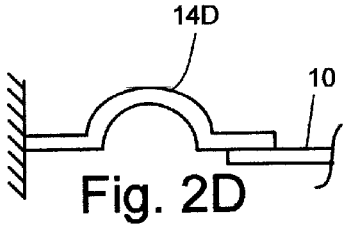
Figure 3A:
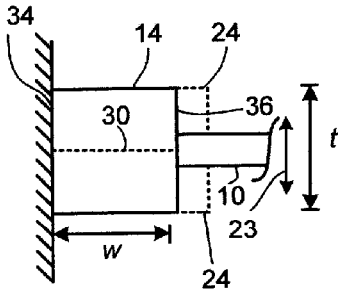
FIGS. 3A and 3B are diagrammatic views of an acoustic assembly including a suspension element, for illustrating shear deformation.

FIG. 3A illustrates a configuration for the suspension element that provides the same excursion with significantly narrower width (or provides more maximum excursion with the same width) than the suspension elements of FIGS. 2A, 2B, and 2D, and in addition is less prone to deformation due to internal enclosure pressures. In the configuration of FIG. 3A, the suspension 14 is a ring shaped mass of compliant material with a width to thickness ratio less than 2:1, in this example about 1:1. In the suspension element of FIG. 3A, shear deformation is a significant component of the total deformation. In shear deformation, motion in the intended direction (indicated by arrow 23) causes the suspension element to deform so that the two suspension element surfaces 34, 36 that are parallel to the intended direction of motion when the diaphragm is in a neutral position, and substantially all cross-sectional planes that are parallel to surfaces 34 and 36 remain substantially parallel to each other and to the intended direction of motion, but are displaced relative to each other in the intended direction of motion. The axis 30 of the suspension element remains straight over most of its length, but becomes non-perpendicular with surfaces 34, 36. With shear deformation, a restorative force (indicated by arrow 37) opposing the motion of the diaphragm 10 is exerted in a direction substantially parallel to the moving surfaces 34, 36. The suspension element 14 may have flanges 24 to capture the diaphragm 10, to increase the surface area of attachment between the suspension element 14 and the diaphragm 10 and between the suspension element 14 and the support structure (depicted here as a mechanical ground), and to eliminate the high stresses that would otherwise occur at the top and bottom edges of the suspension element 14 where it connects to the diaphragm in FIG. 3.

Chemical bonding, or some method of maintaining the connection between the diaphragm and the suspension element may be desirable.

Figure 3B:
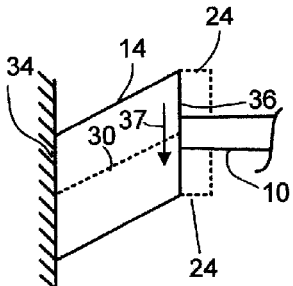

FIG. 3B shows a cross-section of an actual implementation of a suspension element according to FIG. 3A in an undeformed state and a finite element analysis (FEA) simulation of the actual implementation in a deformed state. Subsequent testing on a suspension according to FIGS. 3A and 3B confirms that the actual suspension element behaves substantially as predicted by the FEA simulation.

As stated above, a suspension elements according to FIG. 3A can increase the maximum excursion an acoustic element can provide for a given suspension element width. Alternatively, suspension elements according to FIG. 3A can decrease the width requirement of the suspension element for a given maximum excursion. This advantage is very significant particularly if the space in which the acoustic assembly is limited. If the space is limited, a narrower suspension permits more radiating surface.

In an actual suspension element, the application of the force F to the diaphragm 10 causes both beam deformation and shear deformation to occur in the suspension element, which results in a deflection δ. The amount of deflection is $\delta=FC_{total}$ where $C_{total}$ is the total compliance of the suspension element. The total compliance $C_{total}$ has two components, the beam compliance $C_{beam}$ and the shear compliance $C_{shear}$, so that $\delta=F(C_{beam}+C_{shear})$. $C_{total}$, $C_{beam}$, and $C_{shear}$ are substantially constant over the linear portion of the Force v. Deflection curve. The beam compliance is $$C_{beam} = \frac{0.75w^3}{Elt^3}$$

where w is the width as defined in FIG. 1C, t is the thickness as defined in FIG. 1C, l is the length of the circumferential axis of the suspension element, and E is Young's modulus, and the material is assumed to be incompressible and the width w is assumed to be much less than the outer diameter of the surround. The shear compliance $$C_{shear} = \frac{2(1+v)w}{Elt},$$

where v is Poisson's ratio. If the suspension is assumed to be compressible, v=0.5, $$C_{shear} = \frac{2(1+v)w}{Elt}$$

becomes $$C_{shear} = \frac{3w}{Elt}.$$

Young's modulus E and Poisson's ratio v are properties of the material from which the suspension element is made. The deflection can then be expressed as $$\delta = F\left(\left(\frac{0.75w^3}{Elt^3}\right) + \left(\frac{3w}{Elt}\right)\right),$$

which in terms of the width to thickness ratio $$\frac{w}{t} \text{ is } \delta = F\left(\left(\frac{0.75}{El}\right)\left(\frac{w}{t}\right)^3 + \left(\frac{3}{El}\left(\frac{w}{t}\right)\right)\right).$$

For purposes of analysis, the suspension element may be approximated as a ring with a width w, thickness t, and a depth l which is taken to be $$\frac{\text{inner_diameter} + \text{outer_diameter}}{2}.$$

For a suspension element made of a material such as ECOFLEX® 0010 supersoft silicone rubber available from Smooth-On Inc. of Easton, Pa., USA, url www.smooth-on-.com with a $$\frac{w}{t}$$

values of 5 or greater, the beam component $$\left(\frac{0.75}{El}\right)\left(\frac{w}{t}\right)^3$$

of the compliance is significantly larger than (about 6× or greater) the shear component $$\frac{2(1+v)}{El}\left(\frac{w}{t}\right)$$

and the shear compliance is an insubstantial component of the total compliance. For a suspension element made of ECOFLEX® 0010 supersoft silicone rubber, which has a Young's modulus of about 0.031 MPa and a $$\frac{w}{t}$$

value of 2, the beam component $$\left(\frac{1}{El}\right)\left(\frac{w}{t}\right)^3$$

of the compliance is not significantly larger (about 1× or less) than the shear component $$\frac{3}{El}\left(\frac{w}{t}\right)$$

and the shear component is a significant component of the total compliance. For suspension elements with $$\frac{w}{t}$$

values between 5 and 2, the shear component can be characterized as a transitioning from an insubstantial to a substantial component of the total compliance.

Suspension elements including various combinations of geometries, dimensions, and material parameters, (for example, Young's modulus, Poisson's ratio, shear modulus) can be simulated using finite element analysis (FEA) software to determine if the suspension elements have the desired performance parameters, for example free air resonance, tuning frequency, maximum excursion, frequency range of operation and damping) and that maximum stress and strain limits are not exceeded.

Empirical testing under the actual operating conditions of the combinations of geometries, dimensions, materials, required compliance, and required performance parameters may be advisable, for a number of reasons: some of the parameters may not be specified by the manufacturer; the parameters specified by the manufacturer may have been measured under conditions different than the conditions under which the suspension element is required to operate (for example the suspension element operates in a cyclic manner while the parameters may have been measured statically); or some of the assumptions made by the FEA program may not be valid for the actual operation of the suspension element.

The material from which the suspension element is made can be modified to provide additional features. For example, if the diaphragm of an acoustic element with a suspension made of silicone rubber has non-pistonic modes, for example rocking modes, at a frequency within the range of operation of the acoustic element, the loss factor of the silicone rubber can be modified by adding a softening agent to increase the damping factor (tan delta) of the silicone rubber.

Unlike suspension elements with insubstantial shear compliance, the maximum excursion of a suspension with substantial shear compliance is not limited to less than the width of the suspension; in some implementations, the maximum excursions can be up to four times the width of the suspension before tearing of the suspension.

Figure 4:
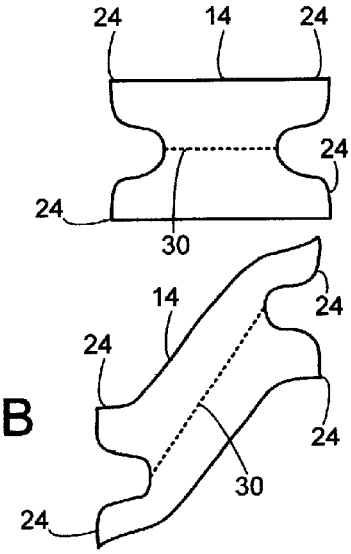
FIG. 4 is a cross sectional view of a tool for manufacturing an acoustic suspension element.
Figure 4:
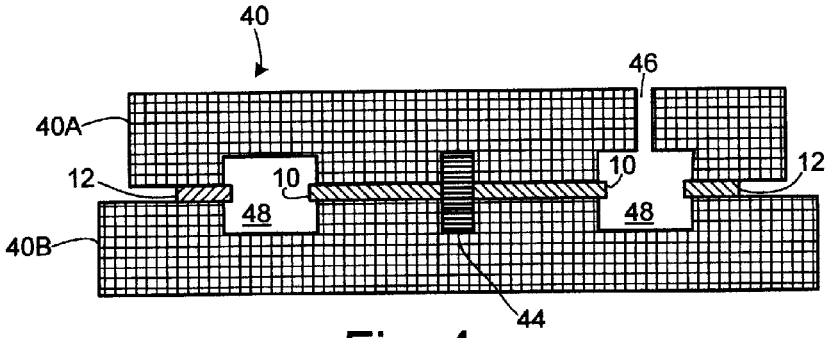
Figure 5:
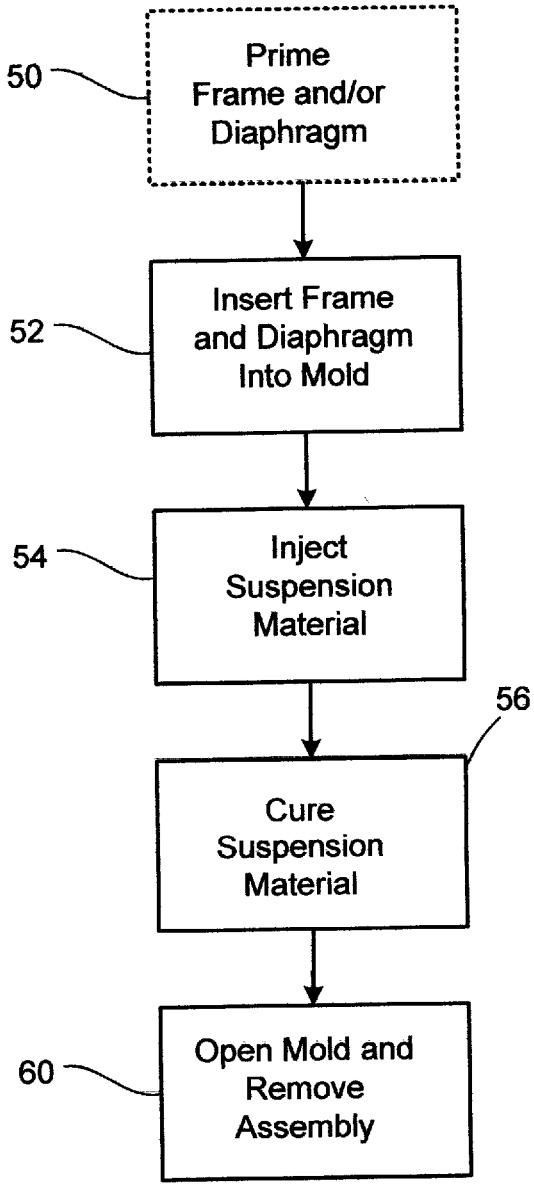
FIG. 5 is a block diagram of a process for manufacturing an acoustic assembly including a suspension element.

FIGS. 4 and 5 show, respectively, a diagrammatic cross-section of an apparatus for forming the acoustic assembly of FIG. 3, and a method for forming the acoustic assembly of FIG. 3. The apparatus of FIG. 4 includes two sections 40A and 40B of a mold 40 for insert molding. Positioned inside the mold 40 are the acoustic diaphragm 10 and if desired, a portion of the support structure 12. A locating dowel or pin 44 may assist in positioning the acoustic diaphragm in the mold. Injection channel 46 provides a passageway through which the material of the suspension element (14 of FIGS. 1 and 3) can be injected into the suspension element cavity 48. The apparatus of FIGS. 4 and 5 may have other features and elements not shown, for example air vent channels, not shown in these views.

In the process of FIG. 5, at optional block 50, the frame and/or the diaphragm are primed. At block 52, the frame and diaphragm are inserted into the mold 40 of FIG. 4. After the two portions 40A and 40B of the mold 40 are closed, at block 54, the uncured suspension material is injected into the suspension element cavity 48 of FIG. 4 through the injection channel 46. Preferably, the suspension element cavity 48 is dimensioned and configured so that the suspension element material flows over the edge of the acoustic diaphragm to form the flanges which capture the acoustic diaphragm. At block 56, the suspension material is cured. At block 60, the mold is opened and the acoustic assembly is removed.

Figure 6A:
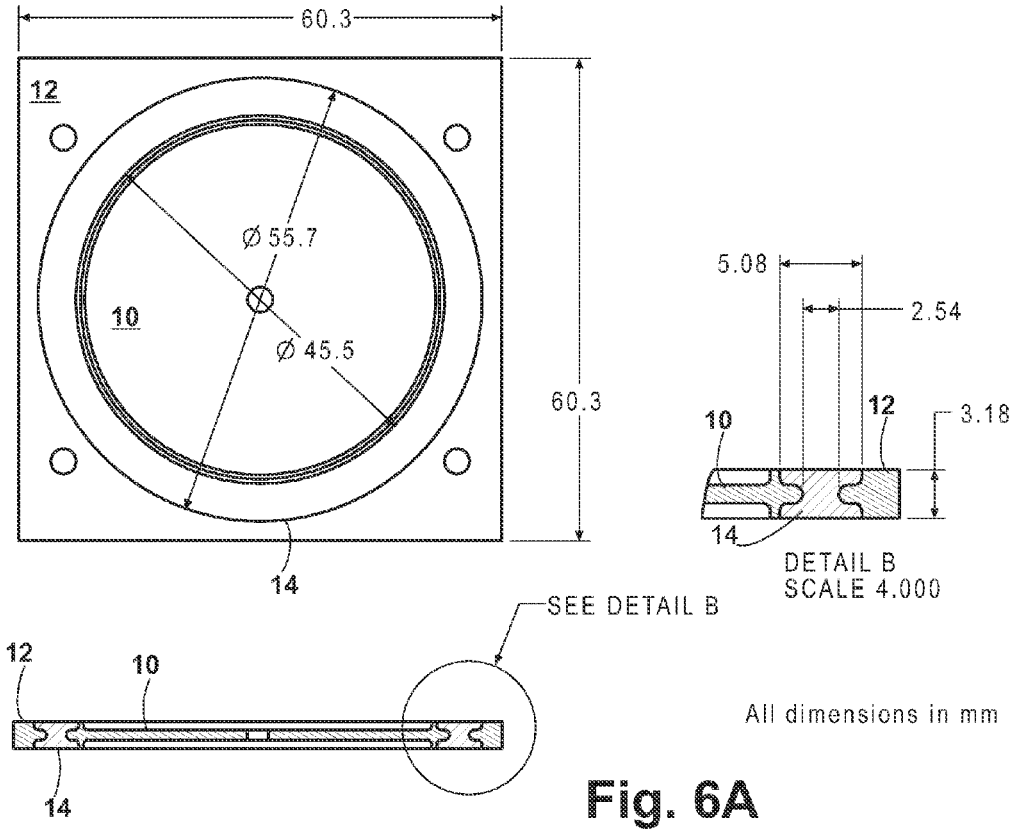
FIG. 6A show views of an actual acoustic assembly including an acoustic suspension element.
Figure 6B:
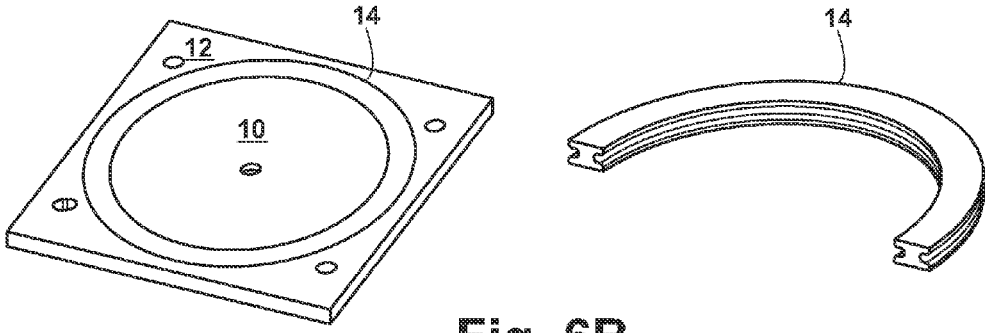
FIG. 6B is a partial isometric view of an actual suspension element and of an acoustic assembly including a suspension element.

The priming at optional block 50 enhances the chemical bonding of the suspension element to the acoustic diaphragm or the frame, or both. An example of an appropriate primer for a silicone rubber suspension element, a polycarbonate acoustic diaphragm, and a polycarbonate frame is MOMENTIVE™ SS4155 silicone primer, currently available from Momentive Materials Inc. of Albany, N.Y., USA, www.momentive.com. For some suspension element materials, for example polyurethanes, priming may not be as advantageous. Chemical bonding may provide better results than friction alone, or to mechanical devices such as clamps FIGS. 6A and 6B show an actual implementation of a suspension element of FIG. 3. The elements of FIGS. 6A and 6B correspond to like numbered elements of previous figures. The suspension element 14 of FIG. 3 is intended for use as a surround of a passive radiator. The suspension element 14 is a ring shaped mass made of Ecoflex silicone rubber with a Young's modulus of 0.031 MPa and has been softened with a softening agent so that the tan delta is 0.58.

Figure 7:
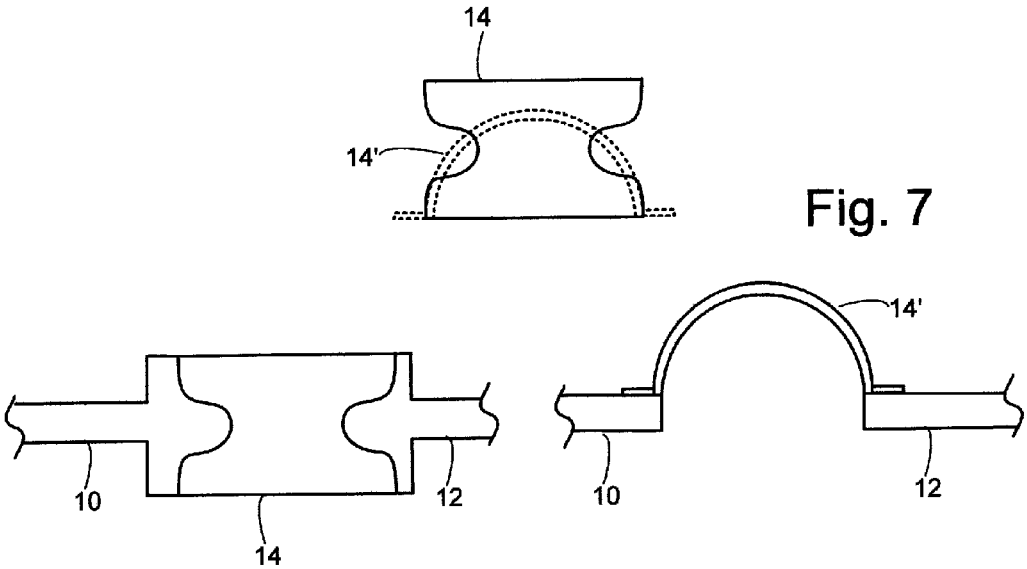
FIG. 7 shows diagrammatic views of an acoustic assembly including a suspension element.

FIG. 7 shows a cross section of the suspension element of FIGS. 6A and 6B, with a diaphragm. For comparison purposes, the suspension element 14 is overlaid on a half roll suspension 14' with the same. FIG. 7 also shows how the suspension elements 14 and 14' could be mounted to the acoustic diaphragm and to the support structure 12.

Figure 8:
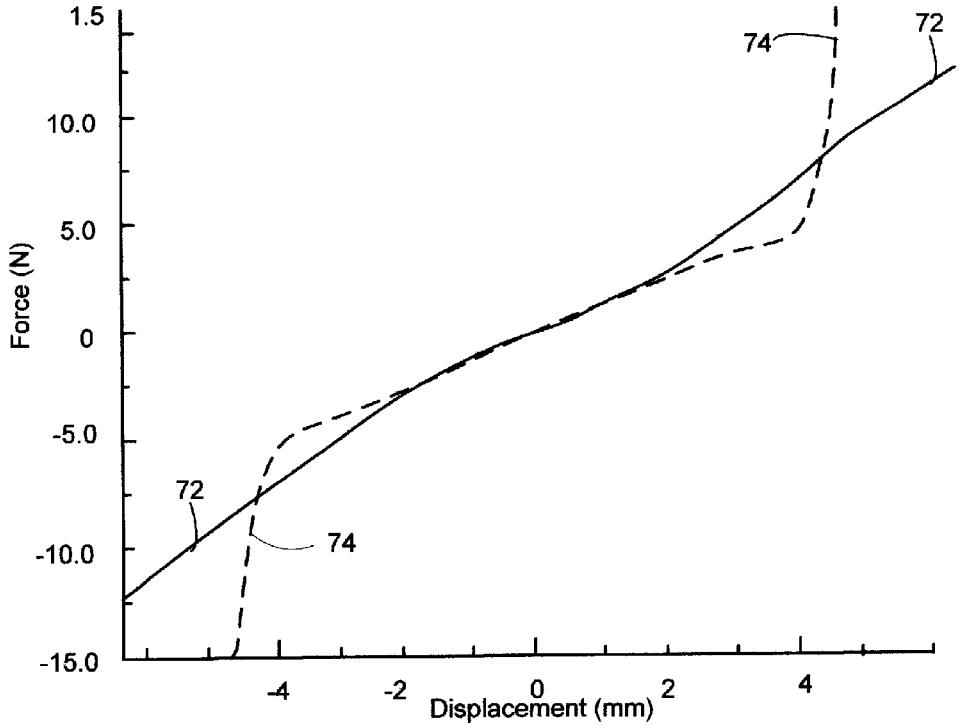
FIG. 8 is a force v. deflection curve for two acoustic suspension elements.

FIG. 8 shows force/deflection curves according to a finite element analysis simulation of the suspensions of FIGS. 6A and 6B using materials with a constant Young's modulus of elasticity (linear stress-strain curve). The force/deflection curve 72 for shear suspension 14 remains substantially linear for at least ±6 mm (=1.2× the width of the surround), while the force/deflection curve 74 for the half roll suspension becomes substantially non-linear at about ±3 mm (=0.6× the width of the surround). The curves of FIG. 8 are a finite element analysis simulation.

Numerous uses of and departures from the specific apparatus and techniques disclosed herein may be made without departing from the inventive concepts. Consequently, the invention is to be construed as embracing each and every novel feature and novel combination of features disclosed herein and limited only by the spirit and scope of the appended claims.

What is claimed is:

1. A suspension element for mechanically coupling an acoustic diaphragm to a stationary element characterized by a total compliance, wherein the total compliance comprises a shear compliance and a beam compliance wherein the beam compliance is calculated according to the equation:

$$_C_{beam} = \frac{0.75w^3}{Elt^3},$$

where w is the width, t is the thickness, l is the length of the circumferential axis of the suspension element, and E is Young's modulus, and the shear compliance is calculated according to the equation:

$$_C_{shear} = \frac{2(1+v)w}{Elt},$$

where v is Poisson's ratio, and;

wherein the beam compliance is not significantly larger than the shear compliance.

2. The suspension element of claim 1, wherein the shear compliance is greater than the beam compliance.

3. The suspension element of claim 1, wherein the material of the suspension element has a Young's modulus of about 0.031 MPa.

4. The suspension element of claim 1, wherein the material of the suspension element is silicone rubber.

5. The suspension element of claim 4, wherein the material is silicone rubber treated with a softening agent.

6. The suspension element of claim 1, wherein the material of the suspension element is a polyurethane.

7. The suspension element of claim 1, wherein the suspension element and the diaphragm are components of a passive radiator.

8. The suspension element of claim 1, the suspension element comprises flanges for capturing the acoustic diaphragm.

* * * * *